US008967336B2

(12) United States Patent
Henseler

(10) Patent No.: US 8,967,336 B2
(45) **Date of Patent: *Mar. 3, 2015**

(54) ELEVATOR CAR WITH MAINTENANCE WINDOW

(71) Applicant: Inventio AG, Hergiswil (CH)

(72) Inventor: Markus Henseler, Immensee (CH)

(73) Assignee: Inventio AG, Hergiswil (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/633,326

(22) Filed: Oct. 2, 2012

(65) Prior Publication Data

US 2013/0019444 A1 Jan. 24, 2013

Related U.S. Application Data

(63) Continuation of application No. 12/520,016, filed as application No. PCT/CH2007/000593 on Nov. 27, 2007, now Pat. No. 8,316,998.

(30) Foreign Application Priority Data

Dec. 20, 2006 (CH) ..... 2069/06

(51) Int. Cl.
*B66B 11/02* (2006.01)
*B66B 5/00* (2006.01)

(52) U.S. Cl.
CPC ..... *B66B 11/0246* (2013.01); *B66B 5/0087* (2013.01); *B66B 5/0025* (2013.01); *B66B 5/005* (2013.01)
USPC ..... 187/401; 187/317

(58) Field of Classification Search
CPC B66B 11/0246; B66B 11/0253; B66B 5/025; B66B 5/0025; B66B 5/0031; B66B 5/005; B66B 5/0087
USPC ..... 187/401, 317, 413
IPC .... B66B 11/02, 13/24; E06B 9/26; E04F 10/08
See application file for complete search history.

(56) References Cited

U.S. PATENT DOCUMENTS 5,454,449 A * 10/1995 Makimattila et al. ..... 187/401
5,721,403 A * 2/1998 Hoppie et al. ..... 187/391

(Continued)

FOREIGN PATENT DOCUMENTS

EP 1031528 A1 * 8/2000 ..... B66B 11/02
EP 1314678 A1 * 5/2003 ..... B66B 5/00
EP 1433734 A1 * 6/2004 ..... B66B 5/00

(Continued)

*Primary Examiner* — William A Rivera

*Assistant Examiner* — Stefan Kruer

(74) *Attorney, Agent, or Firm* — CUSPA Technology Law Associates, P.A.; Yi Li

(57) ABSTRACT

The invention relates to an elevator car which is suitable for elevators in which all of the elements which are to be maintained and checked are arranged outside the elevator car, opposite only one side of the elevator car. The elevator car comprises, on said side, one part (3) that is arranged more than 85 cm above the elevator base (1) on the elevator wall (2) and that can be removed from inside the elevator. The part (3) is as least 95 cm in height and, after being removed, can rest vertically on the base of the elevator (1), against the elevator wall (2), in order to form a balustrade (4). At least one spacer (5, 19) is arranged between the removable part (3) and the lower part (6) of the elevator wall (2) so that the distance from the inner side of the side wall part (3) that is placed on the base (1), facing the elevator, to the elements (7, 8) of the elevator drive moving past the travelling elevator car is at least 10 cm.

15 Claims, 6 Drawing Sheets

(56) References Cited

U.S. PATENT DOCUMENTS

| | | | | |
|---|---|---|---|---|
| 6,851,519 | B2 * | 2/2005 | Ach et al. | 187/266 |
| 8,316,998 | B2 * | 11/2012 | Henseler | 187/401 |
| 2003/0015378 | A1 * | 1/2003 | Elsener | 187/336 |
| 2006/0042883 | A1 * | 3/2006 | Scott | 187/351 |

FOREIGN PATENT DOCUMENTS

| | | | | | |
|---|---|---|---|---|---|
| JP | 10231074 | A | * | 9/1998 | B66B 5/00 |
| JP | 2001106459 | A | * | 4/2001 | B66B 11/02 |
| JP | 2005247454 | A | * | 9/2005 | B66B 5/00 |
| WO | WO 0179104 | A1 | * | 10/2001 | B66B 11/02 |

* cited by examiner 8
7
10cm
11
4
12
13
22
5
2
3
9
6
1
10

ELEVATOR CAR WITH MAINTENANCE WINDOW

CROSS-REFERENCE TO RELATED APPLICATIONS

This application is a continuation of application Ser. No. 12/520,016, filed Jul. 11, 2009, now issued as U.S. Pat. No. 8,316,998 B2, which is a national phase of PCT patent application No. PCT/CH2007/000593 filed Nov. 27, 2007, which claims priority of Switzerland Patent Application No. 02069/06 filed Dec. 20, 2006. All parent applications are hereby incorporated by reference in their entireties.

BACKGROUND OF THE INVENTION

This invention concerns a elevator car with a special maintenance window. The elevators must be inspected and maintained regularly. For this, the following elements are essentially checked and maintained: The rail mountings, the carrying ropes, the carrying ropes mounting, the grooves of the driving pulleys or of the drive tube of a traction drive, the pulleys, the limit switches, the safety brake cable and its mounting and the guides of the chassis or the car as well as the counterweight. These jobs are usually carried out for most of the elevators while the elevator mechanic stands on the roof of the elevator car. This roof must be built according to specification and be provided with a balustrade. For the inspection and maintenance, the elevator car is moved slowly or in slow steps over the entire track so that the elevator mechanic sees all elements with his eyes and has access to all elements on which he must carry out maintenance activities with his hands, retighten some screws, lubricate rotating parts, verify mechanical tensions, test the function of limit switches etc. As additional maintenance option, it is possible in some elevators to swing down the car roof or an opening in the roof into the car after which a work platform can be swung down from the car roof so that it hangs vertically. The elevator mechanic can then climb on this platform via a ladder from the elevator car or from the storey floor through the open elevator car. In another embodiment, he can reach the car roof from the next higher storey floor and from there climb down to this platform with a ladder. If the elevator mechanic stands on this work platform, he will protrude sufficiently out above from the elevator car to such an extent that he can carry out the necessary jobs in the elevator shaft. In still further embodiments, the car walls are equipped with windows, whose window sashes can be swung open into the car interior or sliding windows are provided so that the access to the elevator shaft is made available on the side of this window. Such a solution arises for example from WO01/79104, JP 10-231074 or EP 1 031 528 B1. There, an access opening is revealed, which is provided on that sidewall of the car, which is facing the conveyor of the elevator so that the hoisting device is accessible for maintenance from the inside of the car through this access opening. However, not all the maintenance jobs can be carried out consistently from the car interior by the solutions proposed there. The drive unit lies above the car in the case of WO01/79104 and also JP 10-231074, the guide rails for the car themselves lie outside the area accessible from the car in the case of EP 1 031 528 B1, namely in such side areas of the car that cannot be opened. The fixing and the condition of these guide rails cannot be therefore checked from the car. Often, even the rope guides and their mountings are so situated that they cannot be checked from the car.

BRIEF SUMMARY OF THE INVENTION

The task of this invention is to provide a car with maintenance window, which is suitable for elevators, which have all elements to be maintained and to be checked only on one side outside the elevator car and consequently can be accessed through an opened car sidewall. But for this certain specifications have also to be fulfilled. Thus, for example, the distance of the balustrade up to which the mechanic can stand must be minimum 10 cm up to the rope or other moving parts of the conveyor.

This problem is solved by a elevator car with maintenance window for an elevator in which all elements to be maintained and to be checked are arranged opposite only one side of the elevator car and is, characterized in that, on this side, a part of the car wall arranged more than 85 cm above the car floor is made removable from inside the car, in which this part is minimum 95 cm high, and after removal can be leaned on this car wall while resting on the car floor for the formation of a balustrade, in which minimum one spacer is present between this removable part and the lower part of the car wall, so that the distance from the inner side of the sidewall part that is placed on the floor facing the car to the elements of the elevator drive moving relative to the travelling elevator car is at least 10 cm.

BRIEF DESCRIPTION OF THE DRAWINGS

This elevator car is represented in the drawings and its maintenance window is described based on these drawings and its function is explained.

DETAILED DESCRIPTION OF THE INVENTION

Figure 1:
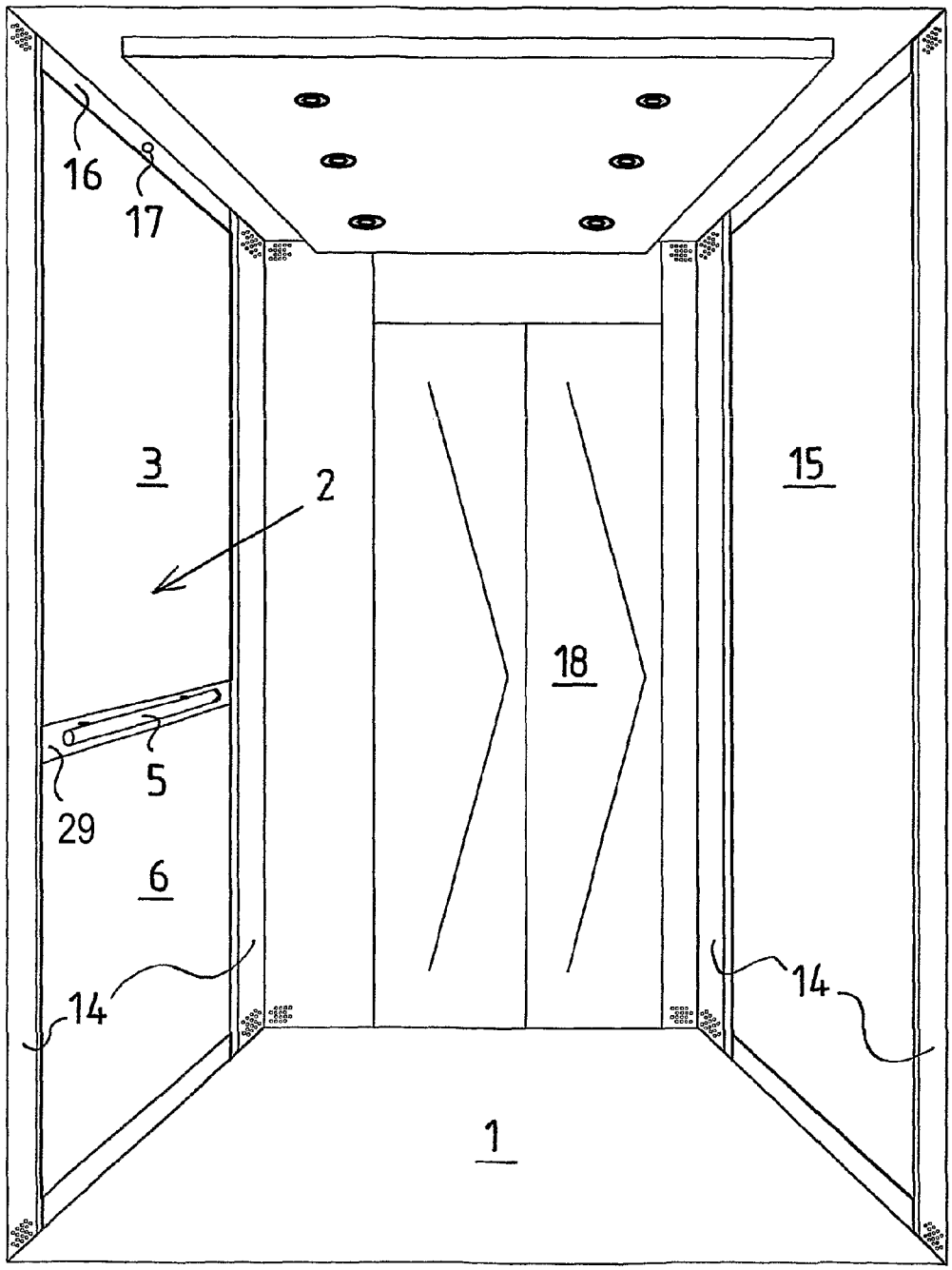
FIG. 1: shows a view of the opened elevator car seen from an access door in the operating condition of the elevator.

In FIG. 1, a view into the opened elevator car is shown as seen from the access door. Here the elevator car is shown in the condition ready for operation. The sidewalls are formed through panels 3,6,15, which are, for example, held by side guide heads 14, which are on their part connected with the frame through plug or screw connections. A fuse rail 16 can, for example, be arranged above along the car roof running horizontally. This is equipped with a closing mechanism, which can be opened with a male triangular spanner or square spanner in which this is inserted in the hole 17 and then turned. A second elevator door 18 out of two door parts movable horizontally outwards is arranged here on the car rear side. As one can recognise, the left sidewall is divided into an upper sidewall part 3 and a lower sidewall 6. A cross support 29 is arranged between these parts, which carries a handrail 5, here in the form of a chrome steel tube, which is projected a few centimeters from the sidewall. Instead of a tube, a strip can also be provided, which can be held behind. The upper sidewall part 3 here can be removed from the elevator car side without much trouble as a special feature. At first the fuse rail 16 is removed by loosening the closing mechanism by means of a key. After the removal of the fuse rail 16, the sideways holding strips 14 are removed. These are, for example, inserted below in profile strips and connected with the frame of the elevator car through a plug or screw connection. After the removal of these holding strips 14, these can be, for example, rested leaning against the opposite car wall for a temporary storage. Now the side rims of the upper sidewall part 3 are made free. This sidewall part 3 can be now held with the hands at the side rims and lifted out from its bottom holding profile, which runs along the upper rim of the lower sidewall part 6, and afterwards put on the car floor 1.

Figure 2:
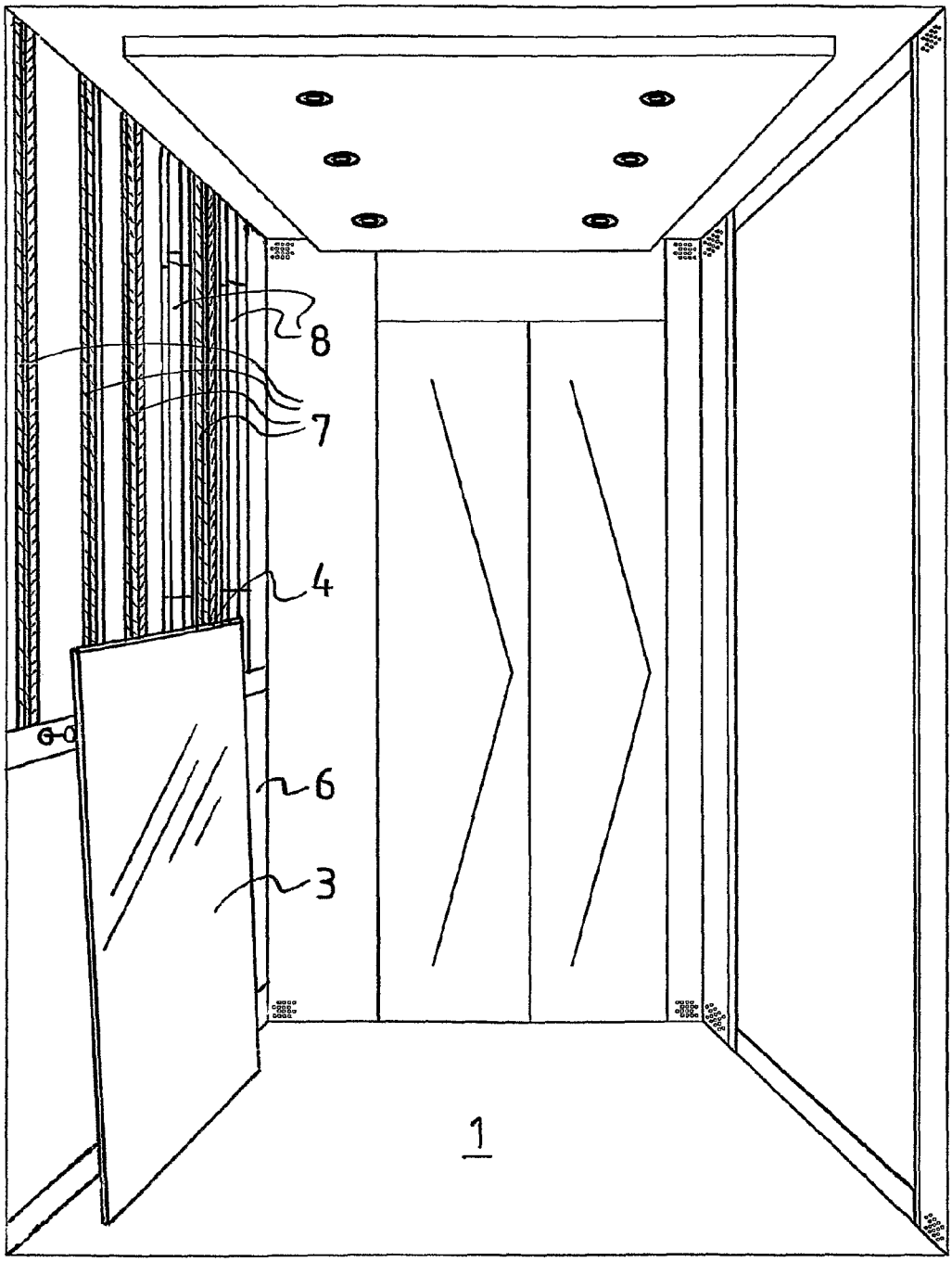
FIG. 2: shows a view into the opened elevator cabin seen from an access door with disassembled upper part of the left sidewall of the elevator cabin and with the same placed on the car floor and leaning on the sidewall.
Figure 3:
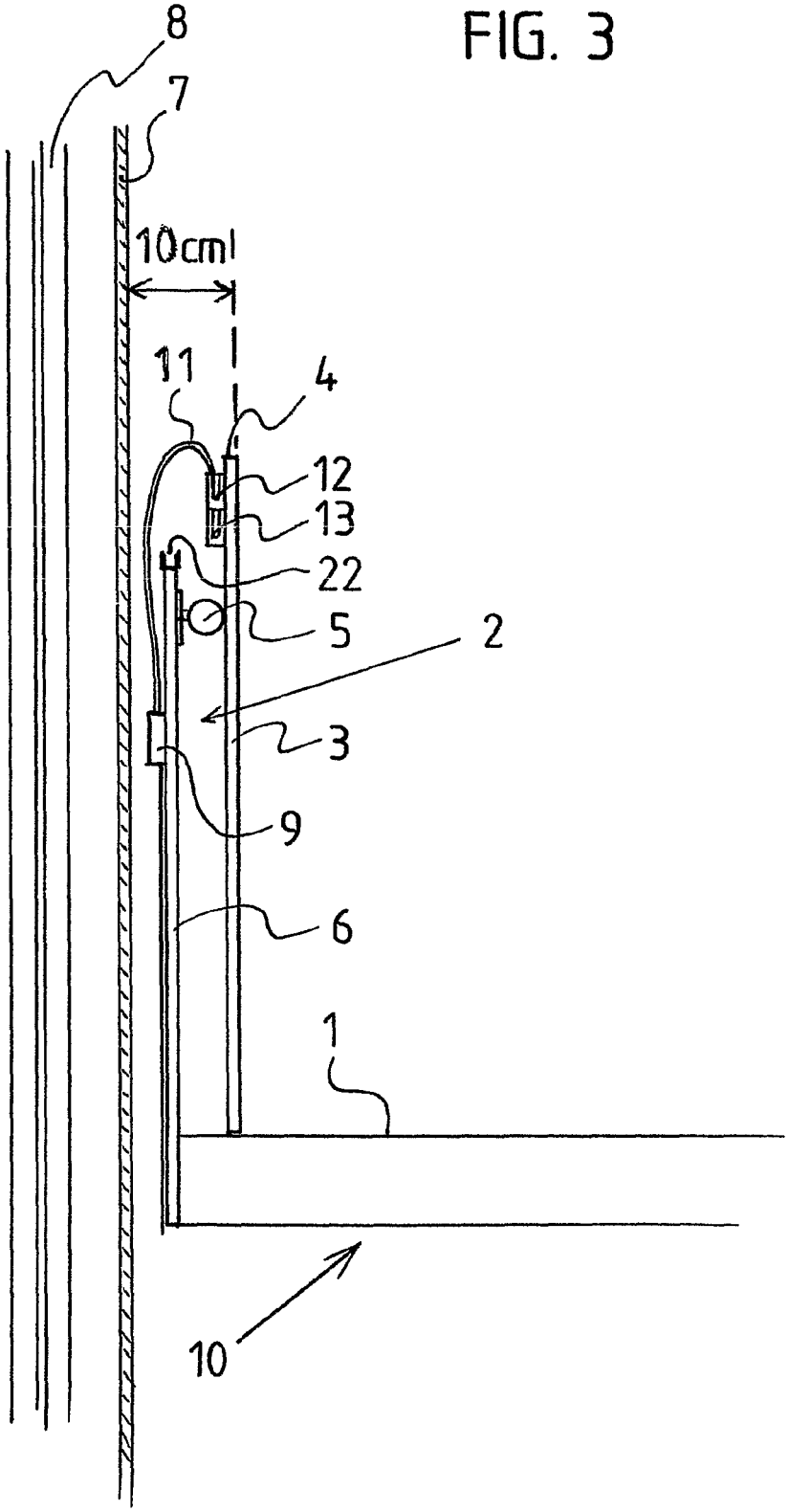
FIG. 3: shows a schematic representation of the elevator car wall, the balustrade formed as well as the safety device for the operation of the elevator car with opened maintenance window.

This situation is shown in FIG. 2. The removable upper sidewall part 3 is placed on the elevator car floor 1 here and is leaned against the handrail 5. Consequently, all elements of the elevator drive, which must be maintained and inspected, can be viewed through the maintenance window created by removal of the upper sidewall part 3 that is placed on the floor, where these elements are also accessible manually. The removable upper sidewall part 3 in a mounted position closes the maintenance window and closes a contact switch assembled outside on the elevator car (not shown here). As soon as the upper sidewall part 3 is removed, the elevator car cannot be moved any more. If the upper sidewall part 3, which is preferably 100 cm in height, is placed on the floor 1 of the car and leaned against the handrail 5, it forms with its upper rim 4 a balustrade according to the requirement of the elevator mechanic, who can carry out his work on the elements of the elevator drive through the open maintenance window now created. In order that the elevator car can be moved during this work and much more for the purpose of the carrying out of these jobs with open maintenance window, it must always be ensured that there is a specific distance of minimum 10 cm between the balustrade and the nearest parts moving relative to the elevator cabin. The placing of the removable upper sidewall part 3 before the lower sidewall part 6 and leaning it against the handrail 5 acts as a spacer. The elevator drives are made as small as possible in order to save space in the elevator shaft. Correspondingly, the supporting and hoisting ropes 7 as well as the guide rails 8 for the elevator car and the counterweight run relatively close to the elevator cabin. This required distance of 10 cm can be easily maintained through the placing of the removed upper sidewall part 3 inside the car interior, as can be seen in FIG. 3.

Now, in a second step, this sidewall part 3 placed on the floor is secured against toppling and simultaneously it is also achieved thereby that the elevator car can be moved again. This is explained by means of FIG. 3, here is represented the upper sidewall part 3 on the elevator car floor before the lower sidewall part 6, seen from the side. A cable hanger 9 is assembled on the outside of the elevator car and a two-pole cable 11 leads from this cable hanger 9 to a plug 12 at the end. This plug 12 can be inserted in a socket 13 as shown here, which is assembled on the back side of the upper sidewall part 3 that can be taken out. The two poles of the plug 12 are electrically connected to each other in the socket 13. Therefore, an electrical circuit is closed as soon as the plug 12 is inserted in the socket 13 so that the elevator cabin can be moved. This plug connection on one hand secures the removable sidewall 3 against toppling and on the other hand it closes an electrical circuit so that the elevator car can be moved. Consequently the elevator car can be moved only if the disassembled sidewall 3 is placed correctly before the lower sidewall part 6 and therefore firstly a balustrade 4 is formed with the required minimum distance to the moving parts, for example the passing ropes 7, and secondly the electrical circuit for the travelling of the elevator cabin is closed. But this contact can be closed only with correctly placed sidewall 3 because only then the plug 12 can be inserted in the socket 13 and the electrical circuit closed.

Figure 4:
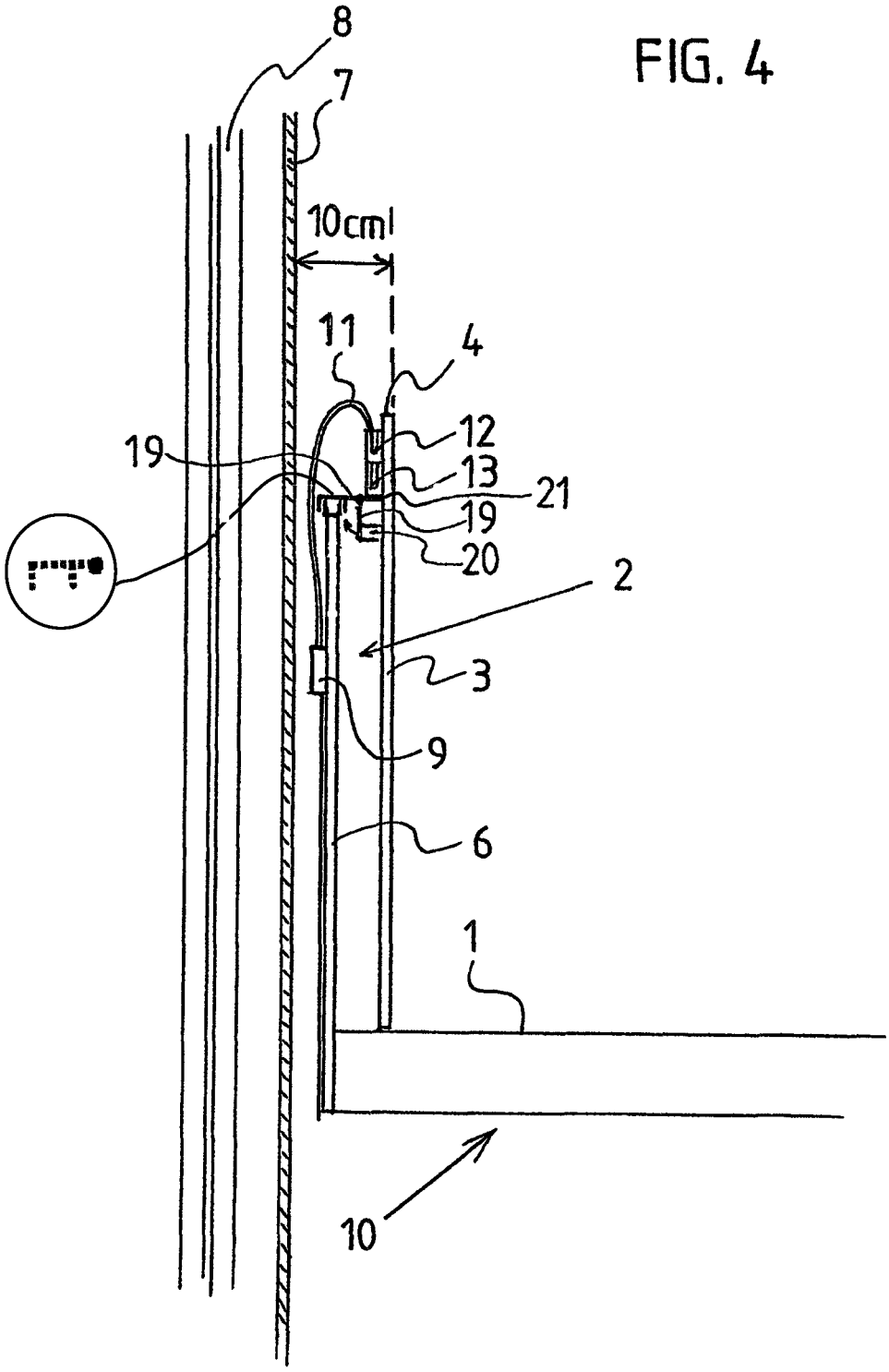
FIG. 4: shows a schematic representation of the elevator car wall, the balustrade formed as well as the safety device for the operation of the elevator car with opened maintenance window.

Instead of a handrail 5, which serves here as spacer for the sidewall part 3 placed, a bracket can also serve, which is assembled on the back side of the sidewall 3. This solution is used for elevators in which no handrail can be provided due to space restrictions. It is depicted in FIG. 4. A bracket 19 that can be swung is pivoted to a support 21, which is assembled on the back side of the sidewall 3. In the swung-down position, it simply hangs on the drag bearing and protrudes only little on the backside of the sidewall 3. After the sidewall 3 is placed on the car floor 1 after disassembly, the elevator mechanic can swing the bracket 19 upwards and put it over the upper rim of the lower sidewall part 6 with its end profile 20. With that, the maintenance of the required distance of minimum 10 cm to the moving parts is also ensured as shown and the sidewall part 3 cannot topple. Then the electrical circuit is also closed next as already explained in FIG. 3.

The removable sidewall part 3 can be a plate glass which can be inserted in a profile strip 22 on the upper rim of the stationary sidewall part 6 and can be secured to the car wall by means of the side holding strips 14. Instead of a plate glass, a transparent sheet glass out of laminated glass can be used or a panel out of wood, plastic or a combination of these materials.

Figure 5:
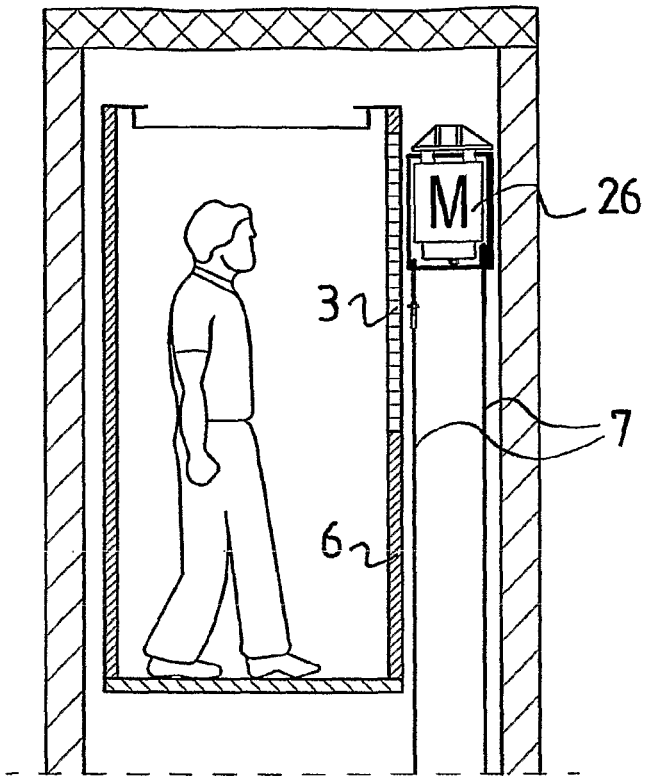
FIG. 5: shows a longitudinal section through the elevator car seen from the side in the topmost position in the elevator shaft with closed maintenance window.
Figure 6:
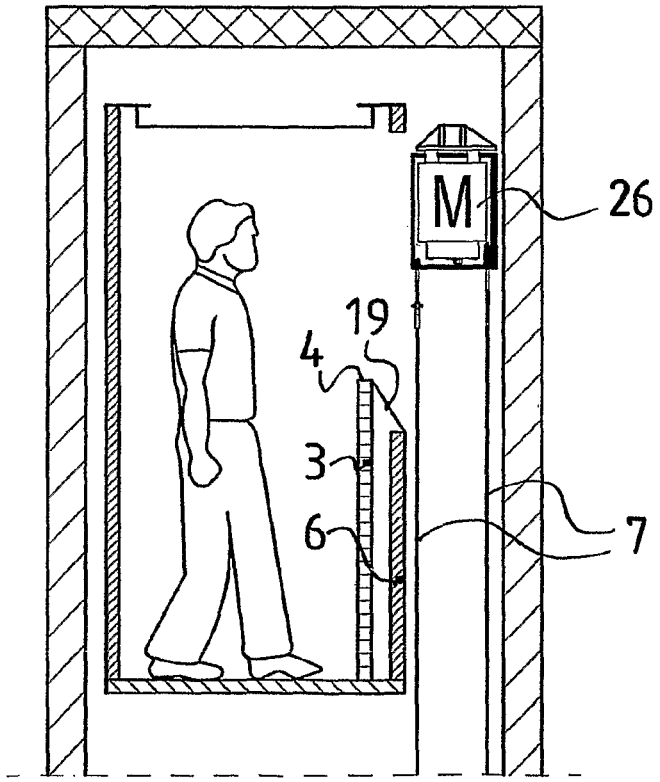
FIG. 6: shows a longitudinal section through the elevator car seen from the side in the topmost position in the elevator shaft with opened maintenance window and balustrade created.

FIG. 5 shows the elevator car in its topmost position in the elevator shaft in a section seen from the side. One can see that, in this topmost position of the elevator car, the elevator motor 26 lies sideways beside the elevator car or that the elevator car can be moved until it is beside the elevator motor 26. The supporting and hoisting ropes 7 run in two planes in which one plane lies right beside the elevator car. In FIG. 6, the maintenance window is opened. The upper sidewall part 3 is correspondingly placed before the lower sidewall part 6 on the car floor 1 at a certain distance. This is defined by the spacer described above either through a stationary handrail 5 or through at least one spacer bracket 19, which can be swung or opened if required on the back side of the removable sidewall part 3. In FIG. 6, one can recognise how a balustrade 4 is formed by this removable sidewall part 3. Minimum 10 cm distance must be maintained from the inner side of the balustrade 4 up to the first rope 7, which can be easily achieved with this arrangement.

Figure 7:
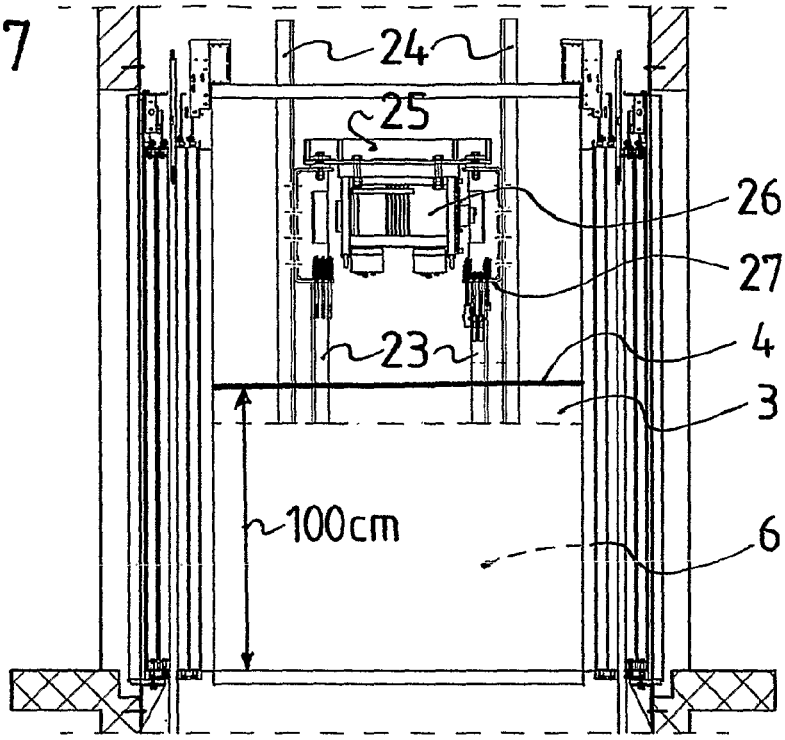
FIG. 7: shows a view of the elevator car with elevator motor and guide rails accessible through the opened maintenance window.
Figure 8:
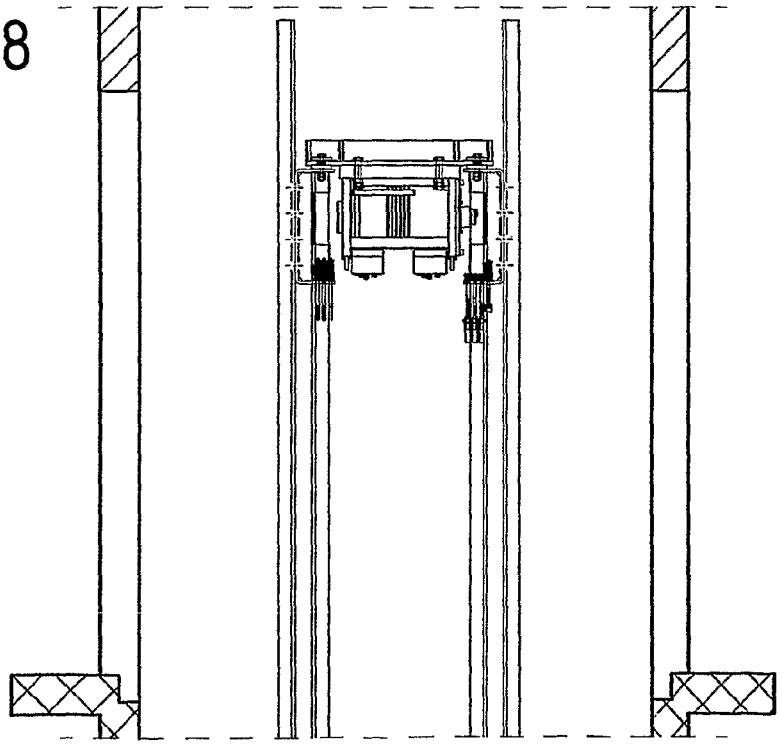
FIG. 8: shows a view of the elevator shaft with the elevator motor and the guide rails when the elevator car hangs further below.

Finally, FIG. 7 shows a view of the elevator car with elevator motor 26 accessible through the opened maintenance window. Here, this consists of a traction drive with an external rotor tube, which serves as drive tube and over which the ropes 7 run, which are however not show here. As special feature, this traction drive is suspended on a bridge 25, which rests upon the inner guide rails 23 for the counterweight via mounting brackets 27, while these brackets 27 are fixed on the outer guide rails 24 for the elevator car. The maintenance window is open up to the lower, for example, 90 cm high sidewall part 6. It extends practically over the entire width of the elevator car. The removable sidewall part 3 is now placed before this maintenance window so that its upper rim 4 projects above the lower sidewall part 6 by 10 cm and forms a balustrade. In the figure, one can recognise the rails 23 for the guidance of the counterweight and the rails 24 for the guidance of the elevator car run parallel to them such that they are arranged outside the motor. This special elevator drive is however not the subject of this invention but only provides a background information. The elevator car with this maintenance window can also be implemented for other drive designs.

This elevator car with maintenance window enables for the first time the maintenance and inspection exclusively from the elevator car. Of course, the assumption is that all drive-related elements are arranged only on one side of the elevator car. The elevator car has an L-shaped chassis for this and the rails for the guidance of the elevator car as well as that for the counterweight run behind the stationery arm of the L. Likewise, the elevator motor, in the form in which is executed always, is arranged behind the stationery arm of the L as also all guide rolls, all fixing elements for the ropes and rails and also all limit switches. Consequently, all these elements can be seen through the maintenance window and are accessible from the car. The maintenance takes place exclusively from the elevator car and is therefore very much more comfortable and clean for the elevator mechanic and moreover faster and safer to carry out.

What is claimed is:

1. A method for maintaining and checking an elevator having an elevator car with maintenance window, comprising:

removing a removable upper sidewall part (3) from a car wall (2) from inside of the elevator car to provide an open window;

resting the removed upper sidewall part (3) on a car floor (1);

connecting a spacer (19) assembled on the removable upper sidewall part to a stationery lower sidewall part (6) of the car wall to form a balustrade (4) with the spacer between the removable upper sidewall part and the stationery lower sidewall part, said balustrade (4) ensuring a distance of at least 10 cm from a side of the removable upper sidewall part facing an interior of the car to elements (7, 8) of an elevator drive moving relative to the elevator car; wherein the spacer (19) includes at least one bracket that can be opened or swung up and attached to an upper rim of the stationery lower sidewall part to connect the removable upper sidewall part rested on the car floor to the stationery lower sidewall part; and performing maintenance or checking of elements outside of the elevator car through the open window from inside of said balustrade (4).

2. The method according to claim 1, further comprising connecting a safety device between the removable upper sidewall part (3) and the stationery lower sidewall part (6) to enable moving of the elevator car, wherein said safety device can only be connected if the removed upper sidewall part on the car floor forms said balustrade (4), and the elevator car with the removable upper sidewall part removed can be moved only when an electrical circuit is closed by connecting said safety device.

3. The method according to claim 2, wherein said safety device includes a cable (11) attached to an outer side of the car wall and a socket (13) assembled on a backside of the removable upper sidewall part, and the cable and the socket can be connected inside the elevator car to close the electric circuit only when the removed upper sidewall part on the car floor forms said balustrade (4).

4. The method according to claim 1, wherein said connecting the spacer (19) on the removable upper sidewall part to the stationery lower sidewall part secures the removable upper sidewall part rested on the car floor against toppling.

5. The method according to claim 1, wherein when the bracket is opened or swung up, a profile section (20) of the bracket is put on the upper rim of the stationery lower sidewall part.

6. An elevator car with maintenance window for accessing elements to be maintained and checked outside of the elevator car, said elevator car comprising a car wall (2) including a removable upper sidewall part (3) and a stationery lower sidewall part (6), a spacer (5, 19) attached to an inner side of stationery lower sidewall part (6) or attached to the removable upper sidewall part (3), and a safety device;

wherein the removable upper sidewall part (3) is removable from inside of the elevator car to form an open maintenance window, wherein removal of the upper sidewall part (3) opens a contact switch assembled outside on the elevator car thereby disabling movement of the elevator car, wherein the removable upper sidewall part (3) when rested on a car floor (1) forms a balustrade (4) with the spacer (5, 19) between the stationery lower sidewall part (6) and the removable upper sidewall part (3), whereby a distance of at least 10 cm from a side of the removable upper sidewall part (3) facing an interior of the car to elements (7, 8) of an elevator drive moving relative to the elevator car is ensured; and wherein said safety device includes a cable (11) attached to an outer side of the car wall (2) and a socket (13) assembled on the backside of the removable upper sidewall part (3), and the cable and the socket can be connected inside the elevator car to close an electric circuit for travelling of the elevator car when the removed upper sidewall part on the car floor forms said balustrade (4); and movement of the elevator car is enabled by connecting the cable and the socket inside the elevator car with the removable upper sidewall part (3) on the car floor maintaining the balustrade (4) and the maintenance window remaining open.

7. The elevator car according to claim 6, wherein the spacer (19) is assembled on the removable upper sidewall part (3), and said spacer (19) comprises at least one bracket that can be opened or swung up and attached to an upper rim of the stationery lower sidewall part to connect the removable upper sidewall part rested on the car floor to the stationery lower sidewall part.

8. The elevator car according to claim 7, wherein a profile section (20) of the bracket can be put on the upper rim of the stationery lower sidewall part, when the bracket is opened or swung up.

9. The elevator car according to claim 6, wherein the removable upper sidewall part is inserted in a profile strip (22) on an upper rim of the stationery lower sidewall part and is secured to the car wall by side holding strips (14).

10. The elevator car according to claim 9, wherein the removable upper sidewall part is a plate glass, a transparent sheet glass of laminated glass, or a panel of wood, plastic, metal or a combination thereof.

11. The elevator car according to claim 6, wherein the cable (11) and the socket (13) are adapted to be connected by a plug connection that connects two poles of the cable electrically to close the electric circuit for travelling of the elevator car.

12. The elevator car according to claim 6, wherein connecting the cable (11) with the socket secures the removable upper sidewall part (3) rested on the car floor against toppling.

13. The elevator car according to claim 6, wherein the removable upper sidewall part is at least 95 cm in height and arranged on the car wall more than 85 cm above the car floor.

14. The elevator car according to claim 6, wherein the spacer (5) is formed of a horizontally arranged handrail attached to the inner side of the stationery lower sidewall part of the car wall and protrudes from the car wall.

15. A method for maintaining and checking an elevator having an elevator car with maintenance window, comprising:

removing a removable upper sidewall part (3) from a car wall (2) from inside of the elevator car to provide an open window, wherein removal of the upper sidewall part (3) opens a contact switch assembled outside on the elevator car thereby disabling movement of the elevator car;

resting the removed upper sidewall part (3) on a car floor (1);

connecting a spacer (19) assembled on the removable upper sidewall part to a stationery lower sidewall part (6) of the car wall to form a balustrade (4) with the spacer between the removable upper sidewall part and the stationery lower sidewall part, said balustrade (4) ensuring a distance of at least 10 cm from a side of the removable upper sidewall part facing an interior of the car to elements (7, 8) of an elevator drive moving relative to the elevator car;

connecting a safety device between the removable upper sidewall part (3) and the stationery lower sidewall part (6) car to close an electric circuit for travelling of the elevator car to enable moving of the elevator car, wherein said safety device includes a cable (11) attached to an outer side of the car wall and a socket (13) assembled on the backside of the removable upper sidewall part, and the cable and socket can be connected if the removed upper sidewall part on the car floor forms said balustrade (4), and movement of the elevator car is enabled by connecting the cable and the socket inside the elevator car with the removable upper sidewall part (3) on the car floor maintaining the balustrade (4) and the window remaining open; and performing maintenance or checking of elements outside of the elevator car through the open window from inside of said balustrade (4).

* * * * *